US009605451B2

(12) United States Patent
Patel

(10) Patent No.: US 9,605,451 B2
(45) Date of Patent: Mar. 28, 2017

(54) WOBBLE FREE EXTERIOR HANDLE DESIGN

(71) Applicant: Ford Global Technologies, LLC, Dearborn, MI (US)

(72) Inventor: Rajesh K. Patel, Farmington Hills, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 253 days.

(21) Appl. No.: 14/179,169

(22) Filed: Feb. 12, 2014

(65) Prior Publication Data

US 2014/0265373 A1 Sep. 18, 2014

Related U.S. Application Data

(60) Provisional application No. 61/782,209, filed on Mar. 14, 2013.

(51) Int. Cl.
*E05B 79/06* (2014.01)
*E05B 85/16* (2014.01)

(52) U.S. Cl.
CPC ..... *E05B 79/06* (2013.01); *E05B 85/16* (2013.01); *Y10T 292/57* (2015.04)

(58) Field of Classification Search
CPC ..... E05B 79/06; E05B 79/22; E05B 77/36; E05B 77/42; E05B 85/10; E05B 85/14; E05B 85/16
USPC ..... 292/336.3, DIG. 23
See application file for complete search history.

(56) References Cited

U.S. PATENT DOCUMENTS 4,486,041 A * 12/1984 Takasaki ..... E05C 3/162 292/221
5,123,687 A * 6/1992 Pfeiffer ..... E05B 1/0092 292/336.3
5,820,290 A 10/1998 Galindo
6,007,122 A * 12/1999 Linder ..... E05B 85/10 292/216
6,363,577 B1 4/2002 Spitzley
7,971,913 B2 7/2011 Sunahara et al.
8,029,032 B1 * 10/2011 Yang ..... E05B 77/06 292/336.3
2006/0143865 A1 7/2006 Magyar et al.
2008/0088139 A1 * 4/2008 Sunahara ..... E05B 85/16 292/336.3
2010/0325841 A1 * 12/2010 Savant ..... E05B 77/06 16/412
2011/0016670 A1 1/2011 Sunahara et al.
(Continued)

FOREIGN PATENT DOCUMENTS

DE 102012020265 B3 * 11/2013 ..... E05B 85/16
DE 102012104775 A1 * 12/2013 ..... E05B 79/06

*Primary Examiner* — Alyson M Merlino
(74) *Attorney, Agent, or Firm* — Jason C. Rogers; Price Heneveld LLP

(57) ABSTRACT

An exterior door handle assembly for motor vehicles is configured to reduce or eliminate wobble or looseness during operation of the door handle. The handle assembly may include a handle member or strap having vertically extending pins at forward and rearward ends of the handle strap, wherein the pins have non-circular cross-sectional shapes to tightly engage a slot in a finger of a bellcrank to thereby prevent wobble of the handle strap in use. The non-circular shapes may be substantially similar to that of a waxing gibbous moon.

12 Claims, 13 Drawing Sheets

(56) References Cited

U.S. PATENT DOCUMENTS

| | | | | |
|---|---|---|---|---|
| 2012/0080892 | A1 | 4/2012 | Nagata et al. | |
| 2013/0134723 | A1* | 5/2013 | Yokoyama | E05B 85/10 292/336.3 |
| 2013/0161964 | A1* | 6/2013 | Ishida | E05B 85/14 292/336.3 |
| 2014/0232121 | A1* | 8/2014 | Ishida | E05B 83/40 292/336.3 |
| 2014/0312633 | A1* | 10/2014 | Ilardo | E05B 77/06 292/336.3 |

* cited by examiner

WOBBLE FREE EXTERIOR HANDLE DESIGN

CROSS-REFERENCE TO RELATED APPLICATION

This application claims the benefit of U.S. Provisional Patent Application No. 61/782,209, filed Mar. 14, 2013, entitled "WOBBLE FREE EXTERIOR HANDLE DESIGN," the entire contents of which are incorporated herein by reference.

FIELD OF THE INVENTION

The present invention generally relates to vehicle exterior door handles, and in particular to a vehicle door handle that does not suffer from looseness or wobble.

BACKGROUND OF THE INVENTION

Exterior vehicle door handles may include a handle strap having a forward end that is pivotably mounted to a door structure to provide for outward rotation of the handle strap about a generally vertical axis. A rear end portion of the handle strap includes an inwardly-extending rear hook or plunger that is operably connected to a vehicle door latch via a bellcrank that transfers motion from the handle to the latch. The bellcrank is connected to the rear hook of the handle/plunger on one of its arms and the other arm is connected to a cable and the cable is connected to a latch such that outward rotation of the handle strap causes the latch to release, thereby permitting the vehicle door to pivot to an open position.

Known exterior door handle designs may suffer from looseness or wobble. Wobble may include looseness between handle and its retention/support structure that is magnified as the handle is pulled outward from its rest position and an upward or downward movement is applied, creating rotation of the handle about the horizontal axis. Thus, if a user pulls outwardly on the handle strap in a somewhat upward or downward direction, the door handle strap will tend to shift vertically, thereby generating the impression that the handle is not securely mounted to the vehicle door structure. Attempts to reduce or eliminate door wobble by reducing tolerances, and other such approaches in conventional handle strap designs has proven to be problematic.

SUMMARY OF THE INVENTION

One aspect of the present invention is an exterior door handle assembly for doors of motor vehicles. The handle assembly includes an elongated strap having a central portion and first and second opposite end portions. The first and second opposite ends portions each include a pivotable connecting element comprising a stem extending horizontally from each respective opposite end portion. Each pivotable connecting element includes upwardly and downwardly extending pivot pins configured to engage vertically spaced apart bearing surfaces to thereby permit rotation of the strap about a generally vertical axis. The pins may have a non-circular cross sectional shape that is substantially the same as a waxing gibbous moon shape to prevent wobble. The pins engage bearing surfaces that are vertically spaced-apart by a relatively large distance to increase the movement arm required to generate wobble and to thereby eliminate looseness or wobble in the handle.

These and other aspects, objects, and features of the present invention will be understood and appreciated by those skilled in the art upon studying the following specification, claims, and appended drawings.

BRIEF DESCRIPTION OF THE DRAWINGS

In the drawings:

FIG. 4;

FIG. 6;

FIG. 9;

DETAILED DESCRIPTION OF THE PREFERRED EMBODIMENTS

Figure 1:
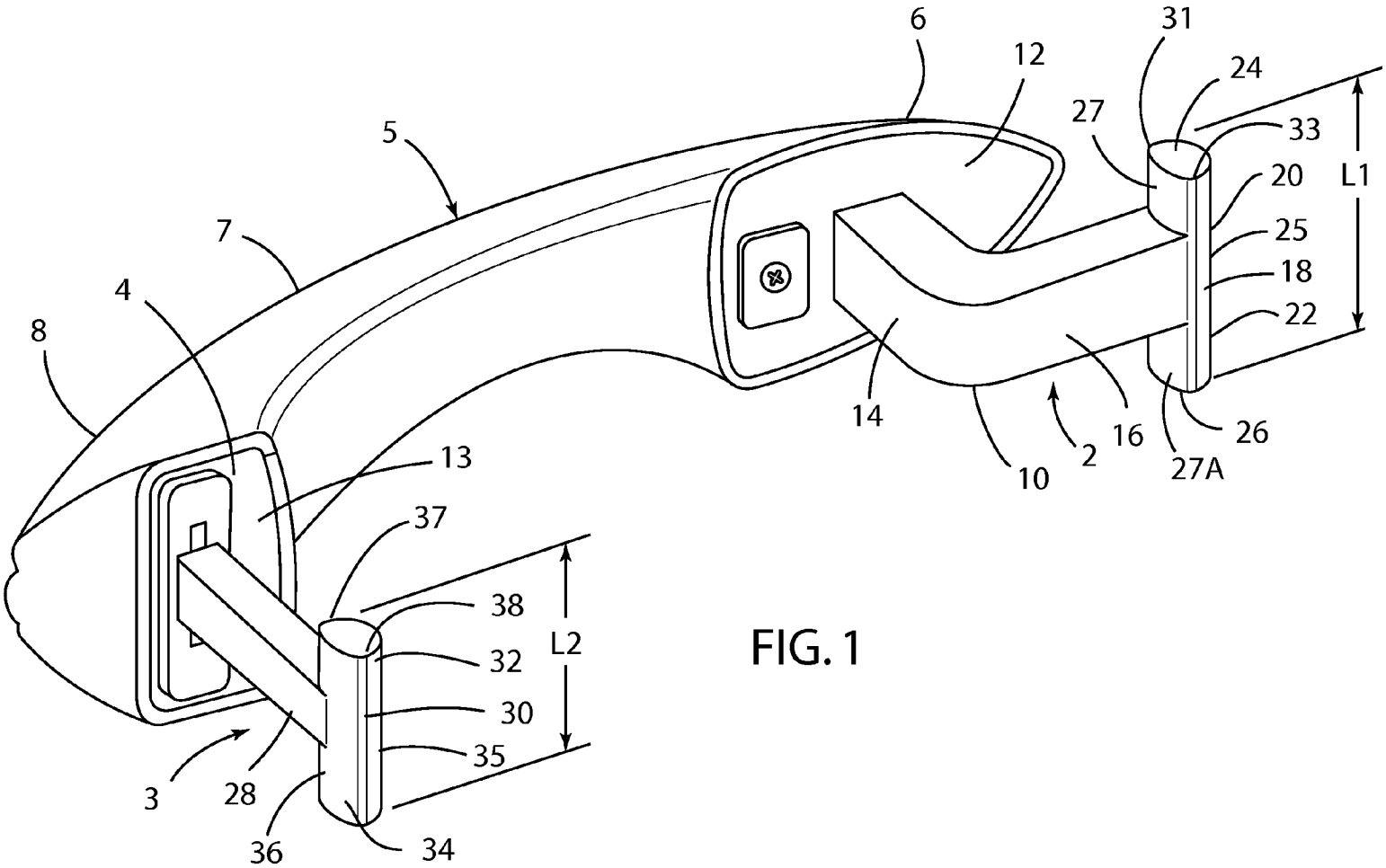
FIG. 1 is an isometric view of a handle for motor vehicle doors according to one aspect of the present invention.

For purposes of description herein, the terms "upper," "lower," "right," "left," "rear," "front," "vertical," "horizontal," and derivatives thereof shall relate to the invention as oriented in FIG. 1. However, it is to be understood that the invention may assume various alternative orientations and step sequences, except where expressly specified to the contrary. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 2:
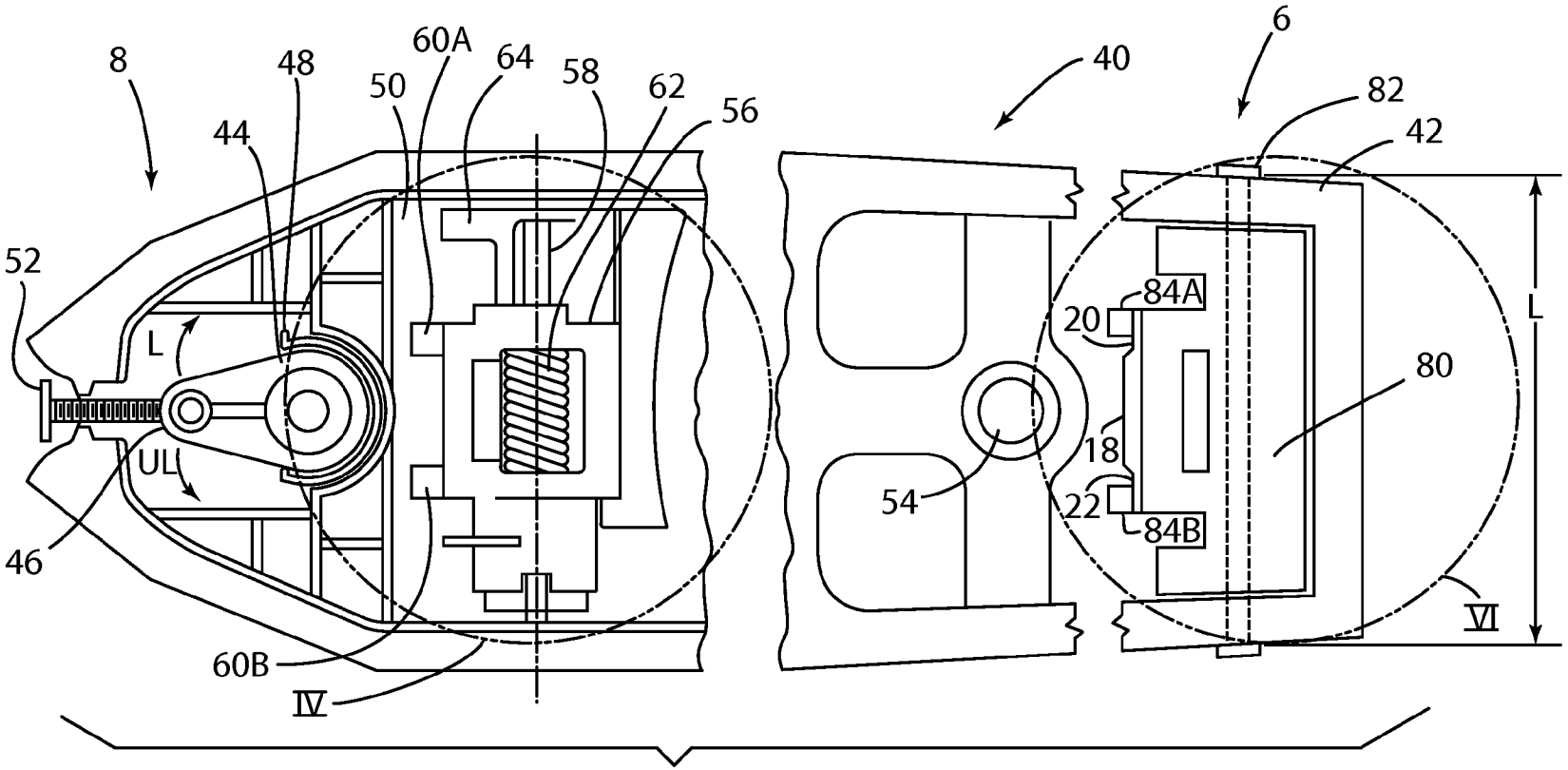
FIG. 2 is a partially fragmentary view of a handle according to the present invention, further including the handle chassis and mounting structures which house the handle mechanism.

With reference to FIG. 1, a handle strap 5 includes a forward end 6 and a rearward end 8. A stem or extension 10 forms a front pivotable connecting structure or hook 2 that includes a first or base portion 14 that extends inwardly from inner surface 12 of handle strap 5, and a second portion 16 of extension 10 extends forwardly. Handle 5 may comprise two pieces, namely, a core 4 molded from Acetal polymer or other suitable material, and a cover 7 made from a polymer such as polycarbonate ABS, or other suitable material. Alternatively, the handle strap 5 can be a one piece gas injection molded handle. The first and second portions 14 and 16 together form an L-shape in plan view. Pin or end portion 18 of extension 10 includes an upper pin 20 and lower pin 22 that extend from second portion 16 in upper and lower directions, respectively. The height "L1" of pin 18 is preferably at least about 28-30 mm. The pins 20 and 22 have a non-circular cross sectional shape, and form ends 24 and 26, respectively. The cross sectional shape of pins 20 and 22 is substantially similar to a waxing gibbous moon. A forwardly-facing cylindrical surface portion 25 extends along pins 20 and 22. Pins 20 and 22 include surfaces 27 and 27A that face rearwardly. The surfaces 27 and 27A have significantly less curvature than the cylindrical surface portion 25. Radii 31 and 33 provide a transition between cylindrical surface portion 25 and surfaces 27 and 27A. As discussed in more detail below, the non-circular shape of pins 20 and 22 prevent wobble of handle strap 5 as handle strap 5 is moved to an open position. Extension 10 may comprise an Acetal polymer that is integrally molded with core 4. Extension 10 may further comprise a Teflon® material that is impregnated in the Acetal. The Teflon may be shot in the same mold cavity with the Acetal. The Teflon® reduces friction between extension 10 and front bellcrank 80 (FIG. 2).

A rear pivotable connecting structure or hook 3 includes an extension or plunger 28. Plunger 28 extends inwardly from rear portion 8 of handle strap 5, and includes a pin or end portion 30 having integral upper and lower pins 32 and 34, respectively. The height "L2" of pin 30 is preferably at least about 28-30 mm. The pins 32 and 34 have a non-circular cross sectional shape that may be substantially similar to a waxing gibbous moon. A cylindrical surface portion 35 of pins 32 and 34 faces forwardly, and a rear surface 36 of pins 32 and 34 faces rearwardly. Surface 34 has significantly less curvature than cylindrical surface 35. Radii 37 and 38 join the surfaces 35 and 36. The handle 5, including extensions 10 and 28 can be made from an Acetal, and the plunger 28 may have a "dual shot" construction comprising Acetal that is impregnated with Teflon® by injecting both materials into the same cavity of a molding tool. However, extensions 10 and 28 may also comprise metal or other suitable material.

Figure 3:
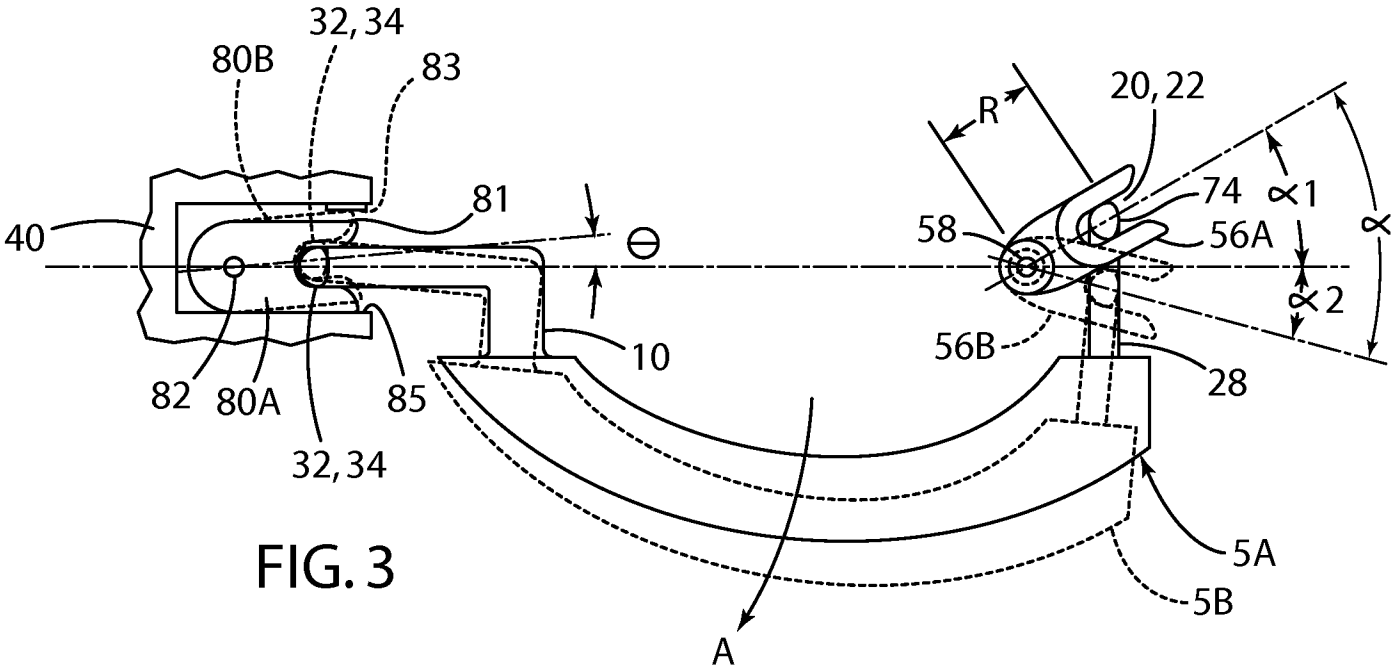
FIG. 3 is a partially schematic plan view showing operation of the door handle of FIG. 1.

In use, handle strap 5 is initially in a home or rest position as designated "5A" (FIG. 3). Also, front bellcrank 80 is initially in a position shown in solid lines "80A." Rear bellcrank 56 is initially in a home or rest position shown in solid lines "56A." In use, a user grasps handle 5, and pulls the handle 5 outwardly causing it to move in the direction of the arrow "A" from the position 5A to the position 5B. Contact between pins 32, 34 and front bell crank 80 cause the front bell crank 80 to rotate in a counterclockwise direction from the position 80A to a position 80B. A stop surface 81 of front bell crank 80 contacts a corresponding stop surface 83 of chassis 40 when the front bellcrank 80 reaches the position designated 80B to thereby prevent rotation of front bellcrank 80 beyond the angle θ. The range of travel/rotation of front bellcrank 80 (i.e. angle θ) is typically very small (e.g. 3° or less). The stop surfaces 81 and 83 prevent the front bellcrank 80 from rotating uncontrollably. It will be understood that the angle θ of FIG. 3 is exaggerated for illustration purposes. As the door handle 5 returns from the open position 5B to the closed position 5A (due to the torsional bias of spring 62), front bellcrank 80 rotates from the position 80B back to the position 80A. A stop surface 85 of chassis 40 prevents further rotation of front bellcrank 80 in the clockwise direction. It will be understood that the stop surfaces 81, 83, 85 of FIG. 3 are schematic in nature, and the actual stop surfaces may be shaped/configured as required for a particular application. Bellcranks 56 and 80 may be made from a metal, polymer, or other suitable material as required for a particular application.

Figure 4:
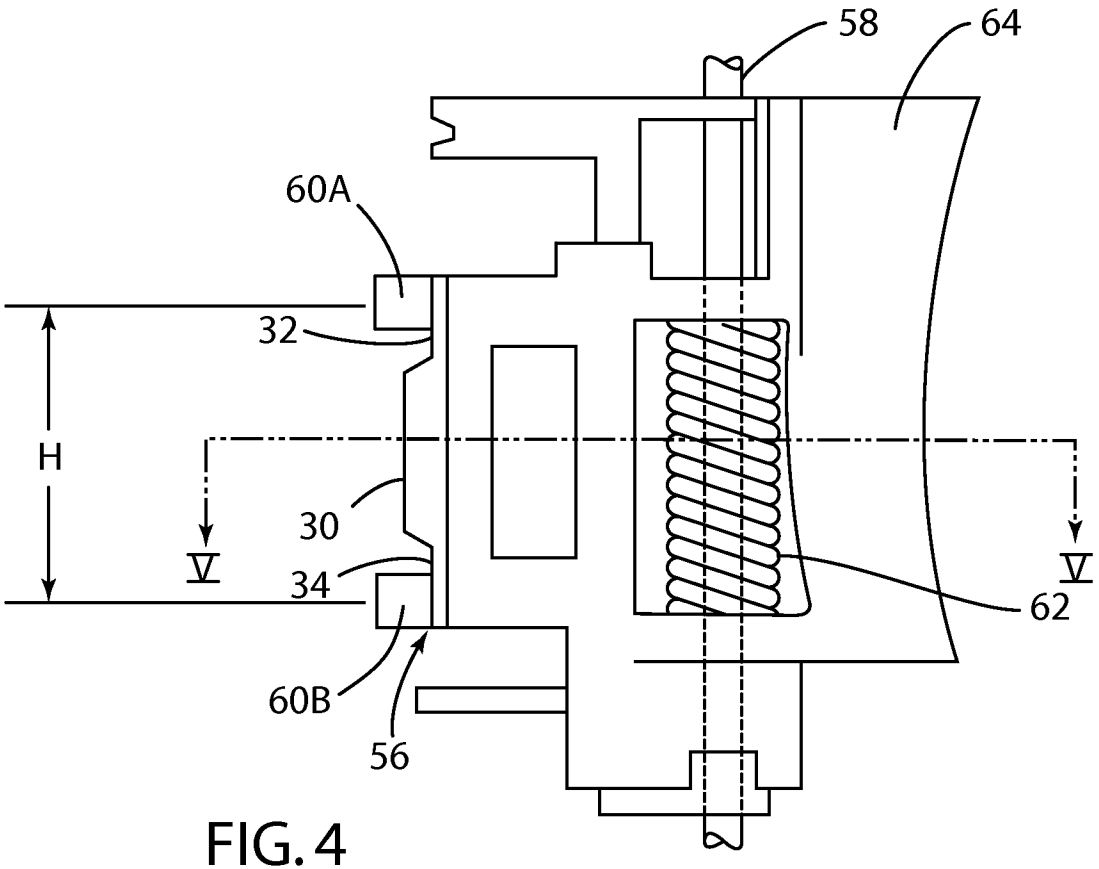
FIG. 4 is a fragmentary enlarged view of the rear bellcrank of the handle assembly of FIG. 3.

Referring again to FIG. 3, as handle 5 is moved from the rest position 5A to an open position 5B, rear bellcrank 56 rotates in a clockwise direction from a home position designated "56A" to an actuated position "56B." Rear bellcrank 56 is initially positioned at an angle α1 (release travel) relative to axis X of about 30°, and rotates to an angle α2 relative to the X axis of about 15° (over travel). Thus, the total angle of rotation a (full travel) of rear bellcrank 56 is about 45° in the illustrated example. However, the angles α, α1, α2 may be selected according to the requirements of a particular application. A coil spring 62 (FIG. 4) biases the rear bellcrank 56 in a counterclockwise direction, and bellcrank 56 therefore tends to pull handle 5 from the open position 5B back to the rest position 5A. As the bellcrank 56 rotates from the position 56A to the position 56B (FIG. 3), the bellcrank actuates a cable, rod, or other linkage to thereby unlatch a vehicle door in a known manner.

As discussed above in connection with FIG. 5, the pins 32 and 34 of handle 5 have a non-circular gibbous moon shape that contacts surfaces 70 and 72 of slot 74 of slotted fingers 60A and 60B along lines of contact 76 and 78. The lines of contact 76 and 78 form a sliding frictional joint between pins 32, 34 and slotted fingers 60A, 60B of bellcrank 56. As the rear bellcrank 56 rotates, the pins 32 and 34 sink further into the slot 74, and pins 32 and 34 travel past a bottom position near bottom portion 75 of slot 74. The pins 32 and 34 then move back out towards the entrance 73 of slot 74. As discussed above, the bellcranks 56 and/or 80, and the pins 20, 22, 32, and 34 may be made of low friction polymer materials such as Acetal that is impregnated with Teflon®. Furthermore, grease or other lubricants may also be utilized to further reduce friction. This may provide a near zero friction joint and smooth operation. The gibbous moon shape of the pins 20, 22, 32, and 34 minimize friction by providing a consistent line contact throughout the travel of the bellcranks 56 and 80. Furthermore, the double line contact prevents any wobble movements from rotating the extensions 10 and 28 of handle 5.

As the handle 5 is pulled outwardly from the position 5A to the position 5B, the pins 20 and 22 rotate about a radius "R" about pin 58. The radius R is relatively large, and may be on the order of 175-185 mm depending on the pivot arm of the handle 5, the styling of the handle, and other such factors. However, the pins 20 and 22 remain trapped within the slots 74 of slotted fingers 60A and 60B of bellcrank 56.

As discussed above, the total rotational travel of rear bellcrank 56 from the home or rest position 56A to the open or actuated position 56B may be about 45°. In the illustrated example, the pins 20 and 22 travel inwardly within slot 74 towards the bottom portion 75 of slot 74 (FIG. 5) as the front bellcrank 56 initially rotates through an angle α1 of 30°, and the pins 20 and 22 then begin to travel from the bottom portion 75 of slot 74 towards the opening 73 of slot 74 as the rear bellcrank 56 rotates through a second angle α2 of about 15°. The magnitude of the angles α, α1, and α2 may vary depending upon the requirements of a particular application. For example, specific latch designs may have different latch full travel and release travel requirements, and the handle may need to reach the latch release travel at a different angular position (i.e. at 50% of full travel or 75% of full travel, etc.).

With further reference to FIG. 2, a handle chassis 40 includes a bezel member 42 that is preferably made of a suitable polymer material such as nylon. A lock cylinder 44 provides for rotation of a lock cylinder pawl 46, and a lock cylinder pawl spring 48 biases the pawl 46 in a lock direction as indicated by the arrow "L." Rotation of pawl 46 in the unlocked ("UL") direction causes unlocking of the vehicle latch in a known manner. A screw 52 secures the bezel member 42 to a reinforcement structure 50. Reinforcement structure 50 may be made of molded polymer or other suitable material. A threaded boss 54 provides for attachment of reinforcement structure 50 to a door structure.

A rear bellcrank 56 is pivotably mounted to the reinforcement structure 50 by a pin 58. A torsion spring 62 (FIG. 4) biases the rear bellcrank 56 towards a latched position. Rear bellcrank 56 may be operably interconnected to a door latch (not shown) utilizing known cables, rods, or other suitable linkage mechanisms such that rotation of rear bellcrank 56 unlatches the door latch. A counter mass 64 offsets forces acting on the handle and bellcrank in a manner that would otherwise tend to unlatch the door in the event of a side impact. The counter mass 64 may be substantially similar to known counter mass designs, and the details of the counter mass 64 will therefore not be described in detail herein.

Figure 5:
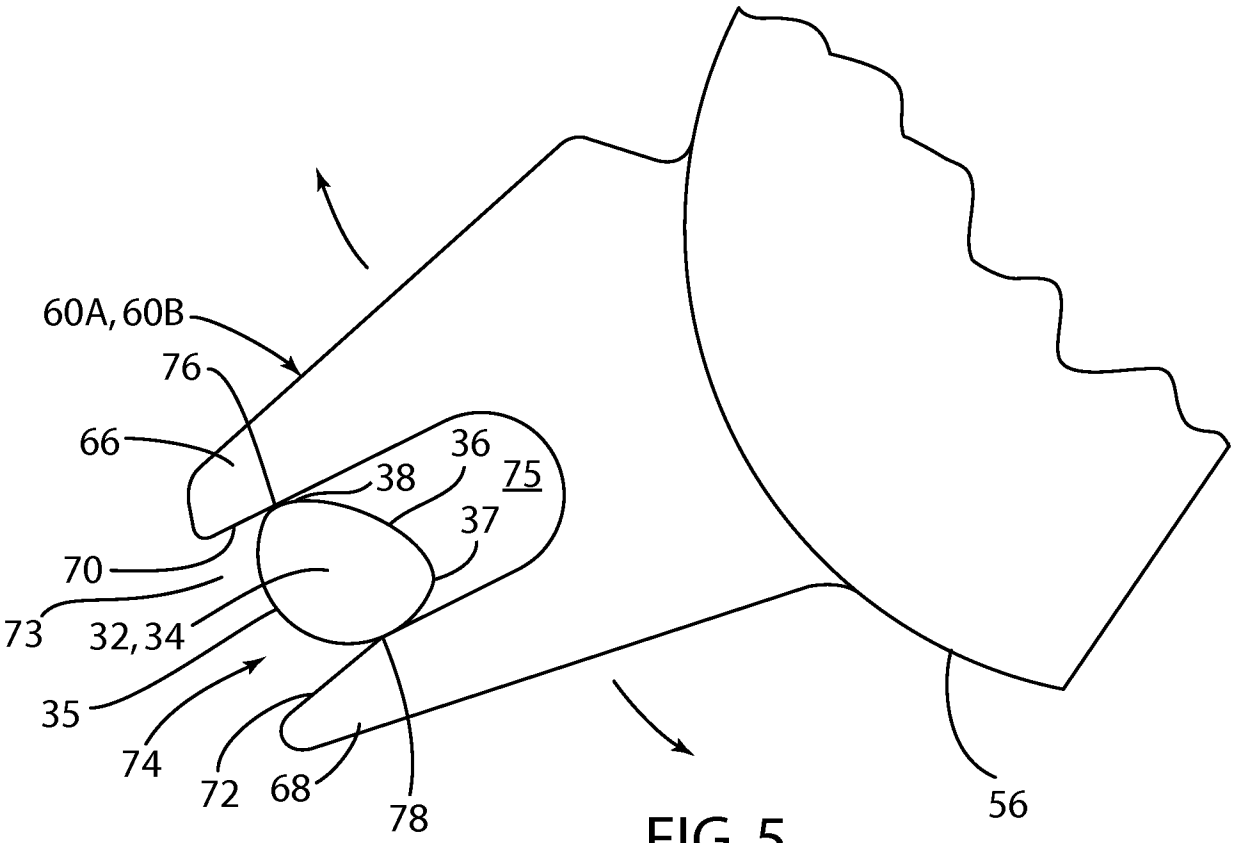
FIG. 5 is a fragmentary, enlarged view taken along the line V-V.

Rear bellcrank 56 includes upper and lower slotted extensions or fingers 60A and 60B, respectively. (See also FIG. 5) Each finger 60A and 60B includes a pair of prong-like extensions 66 and 68 having inner surfaces 70 and 72, respectively that form a slot or gap 74 that receives the pins 32 and 34. The pins 32 and 34 become wedged into slot or gap 74, and form lines of contact 76 and 78 with surfaces 70 and 72, respectively to thereby ensure a snug/tight fit between pins 32 and 34 and slotted finger 60A, 60B. As shown in FIG. 5, the non-circular cross sectional shape of pins 32 and 34 ensures that the pins 32 and 34 are tightly received in slot or gap 74 of slotted fingers 60A, 60B to thereby prevent unwanted movement of the handle strap 5. As discussed below, pins 32 and 34 remain in contact along lines of contact 76 and 78 as pins 32 and 34 rotate relative to front bellcrank 80. The cross sectional shapes of the pins 32 and 34 may be substantially similar to the shape of a waxing gibbous moon. However, the cross sectional shape may vary depending on the geometry of the hooks 60A and 60B as required to form lines of contact 76 and 78 to prevent wobble of handle 5. The vertical distance "H" (FIG. 4) between slotted fingers 60A and 60B is preferably about 75-80 mm to thereby stabilize the rear end 8 of handle strap 5 when pins 32 and 34 are received in slotted fingers 60A, 60B.

Figure 6:
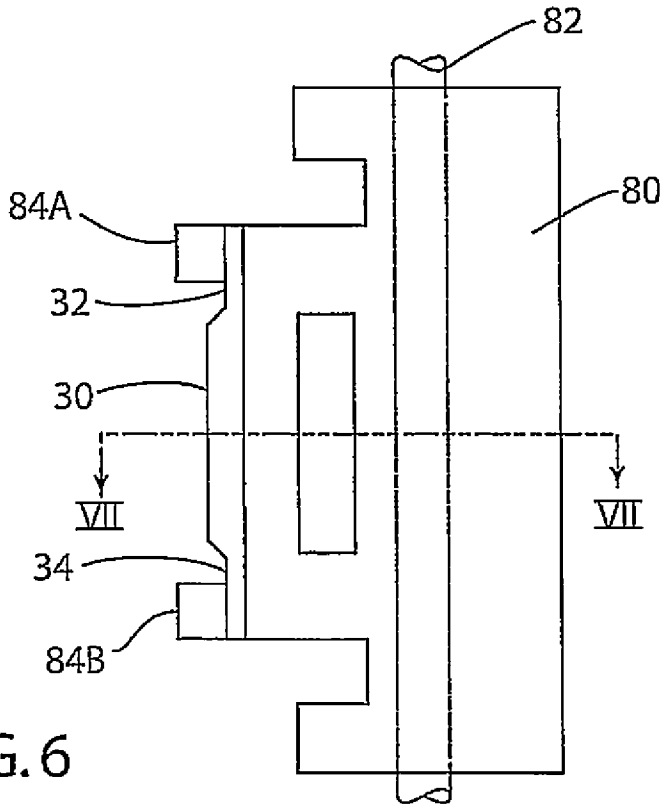
FIG. 6 is an enlarged view of the pivotable front crank of the handle assembly of FIG. 3.
Figure 7:
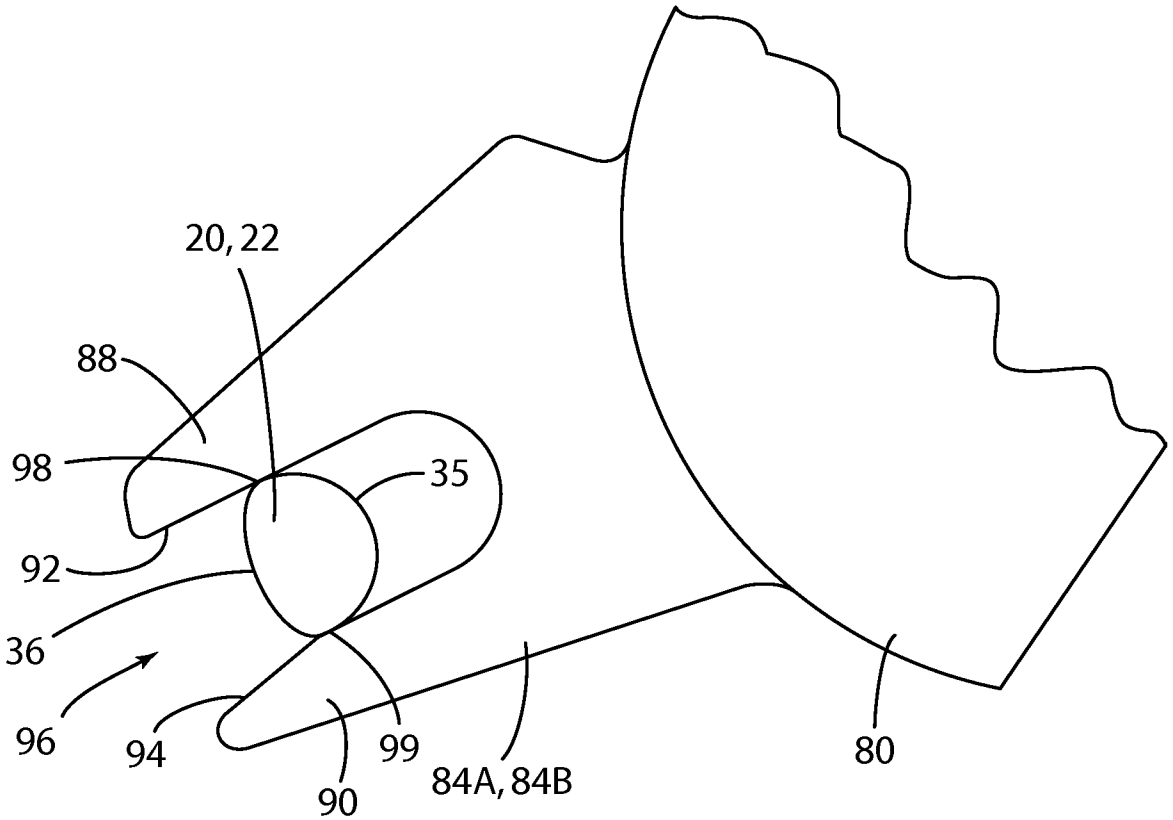
FIG. 7 is a view of a portion of the handle assembly taken along the line VII-VII.

With further reference to FIGS. 6 and 7, a front bellcrank 80 is pivotably mounted to the bezel member 42 by a pin 82. Bellcrank 80 is preferably made of a suitable polymer or metal material, and pin 82 may be made of metal or other suitable material. Pins 20 and 22 of handle strap 5 are received in gaps or slots 96 of upper and lower slotted fingers 84A and 84B, respectively. Slot 96 is defined by inner surfaces 92 and 94 of extensions 88 and 90, respectively, of slotted fingers 84A and 84B (FIG. 6). Pins 20 and 22 are tightly/snuggly received in the slot 96 and form lines of contact 98 and 99 that prevent wobble of handle strap 5 in use. The non-circular cross sectional shapes of pins 20 and 22 is selected to ensure that pins 20 and 22 engage the surfaces of slot 96 along lines of contact 98 and 99 as handle 5 rotates outwardly. Furthermore, the pivot pin 82 preferably has an overall length "L" (FIG. 2) of about 90 mm to provide a stable structure to eliminate wobble or looseness.

When the handle strap 5 is pulled outward to its full travel position and an upward or downward moment is applied (i.e. the moment that causes wobble in conventional handles), it is the combined effect of the relatively large height (dimensions L1, L2; FIG. 1) of front hook 2 and rear hook 3 with non-circular gibbous moon shaped pins 18 and 30 and the U-shaped slots in forks or bellcranks 56, 80 that form lines of contact to react the moment that causes wobble in conventional handle designs.

Figure 8:
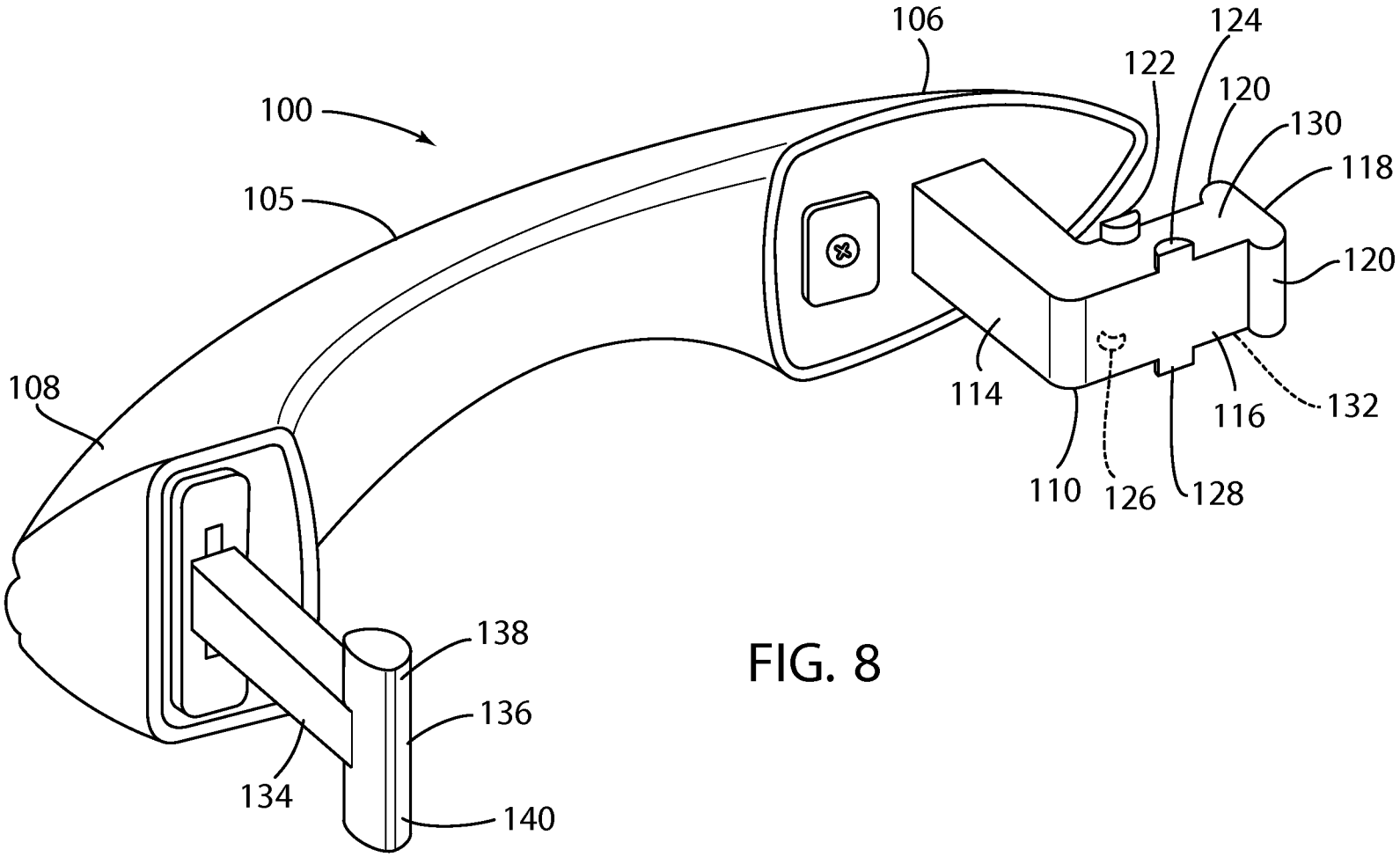
FIG. 8 is an isometric view of a handle for vehicle doors according to another aspect of the present invention.

With further reference to FIG. 8, a door handle 100 according to another aspect of the present invention includes a handle strap 105 having forward and rearward ends 106 and 108, respectively. An extension 110 includes an outwardly extending portion 114, and a transversely extending portion 116. The portions 114 and 116 together form an L-shape in plan view. End 118 of transverse portion 116 includes cylindrical surface portions 120. Transverse portion 116 includes an upwardly facing planar surface 130, and a downwardly facing planar surface 132 that is substantially a mirror image of surface 130. A pair of stabilizing pads 122 and 124 protrude upwardly from upper surface 130, and a pair of downwardly extending pads 126 and 128 extend downwardly from lower surface 132. Rearward end 108 of handle strap 105 includes an extension 134 having an end 136 having upwardly and downwardly extending pins 138 and 140, respectively. Pins 138 and 140 have non-cylindrical cross-sectional shapes that are substantially identical to the pins 32 and 34 described in more detail above in connection with FIG. 1.

Figure 9:
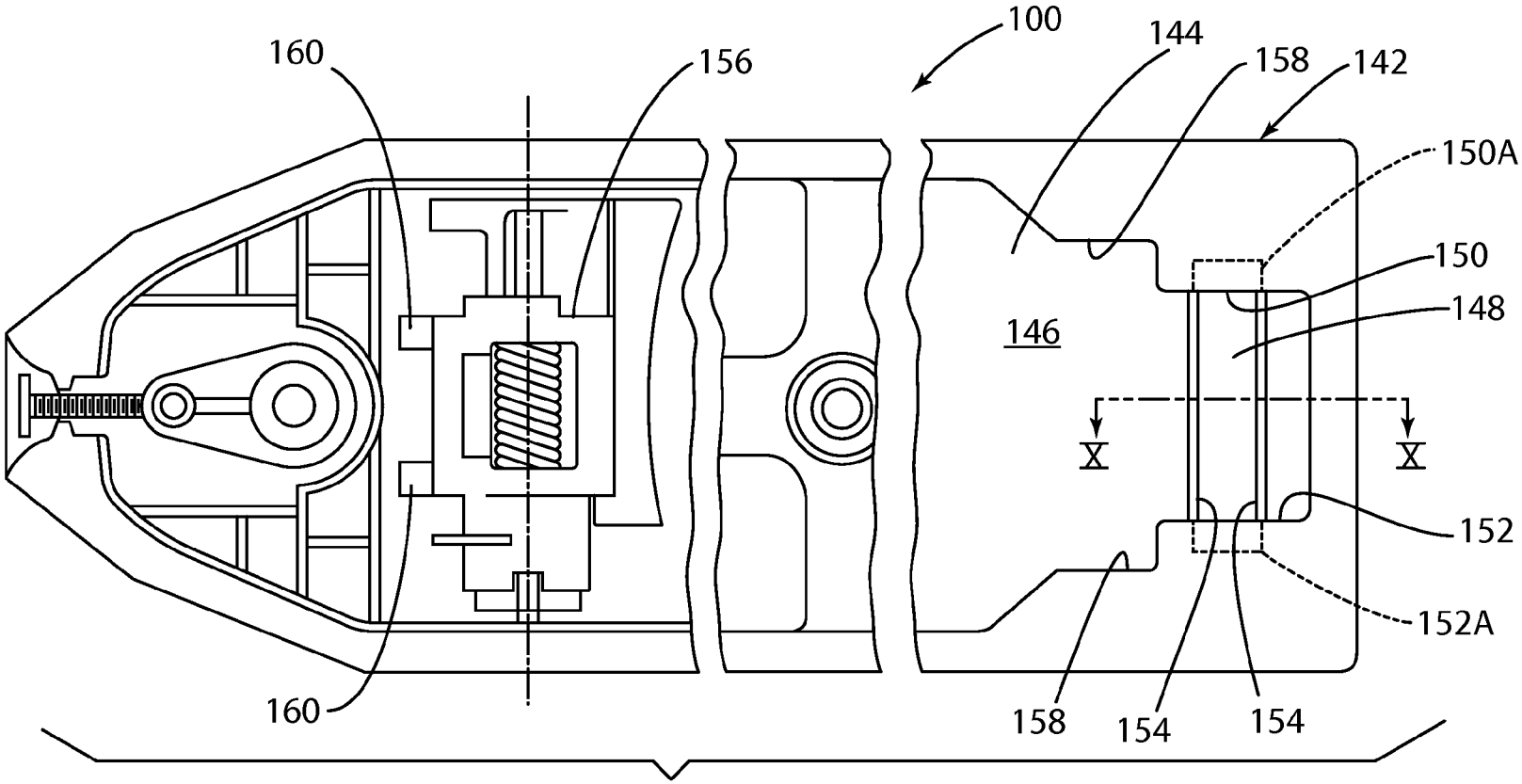
FIG. 9 is a fragmentary view of the handle of FIG. 8 showing the handle chassis structure.

With further reference to FIG. 9, extension 134 and pins 138 and 140 rotatably engage a bellcrank 150 that is substantially identical to the bellcrank 56 described in more detail above in connection with the embodiment of FIGS. 1-7. Bellcrank 150 includes slotted fingers 160 that are substantially identical to the slotted fingers 60A and 60B described in more detail above in connection with FIG. 5.

A support structure or chassis 142 is made of a low friction polymer material or the like. Chassis 142 includes a sidewall 146 having a slot 148 therethrough. A pair of generally planar surfaces 150 and 152 face one another in the vicinity of the slot 148. Slot 148 includes tapered surfaces 154.

Figure 10:
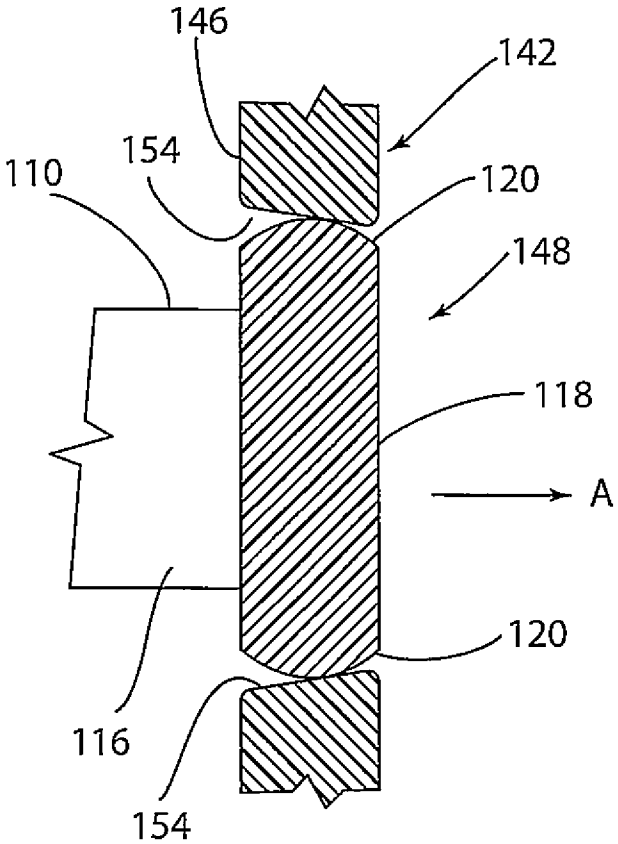
FIG. 10 is a cross sectional view of the handle assembly of FIG. 9 taken along the line X-X.

With further reference to FIG. 10, when assembled, cylindrical surfaces 120 of end 118 of transverse portion 116 of extension 110 slidably engage tapered surfaces 154 to thereby limit movement of extension 110 in the direction of the arrow "A." However, the cylindrical surfaces 120 readily slide against tapered surfaces 154 to thereby permit rotational movement of handle strap 105 about a vertical axis. Upper and lower surfaces 130 and 132 (FIG. 8) of extension 110 may slidably engage inwardly facing surfaces 150 and 152 of support structure 142 (FIG. 9). Furthermore, pads 122, 124, 126, and 128 slidably engage side surfaces 158 of pocket 144 support structure 142 to further stabilize handle strap 105 and prevent rotation of handle strap 105 about a horizontal axis.

Figure 11:
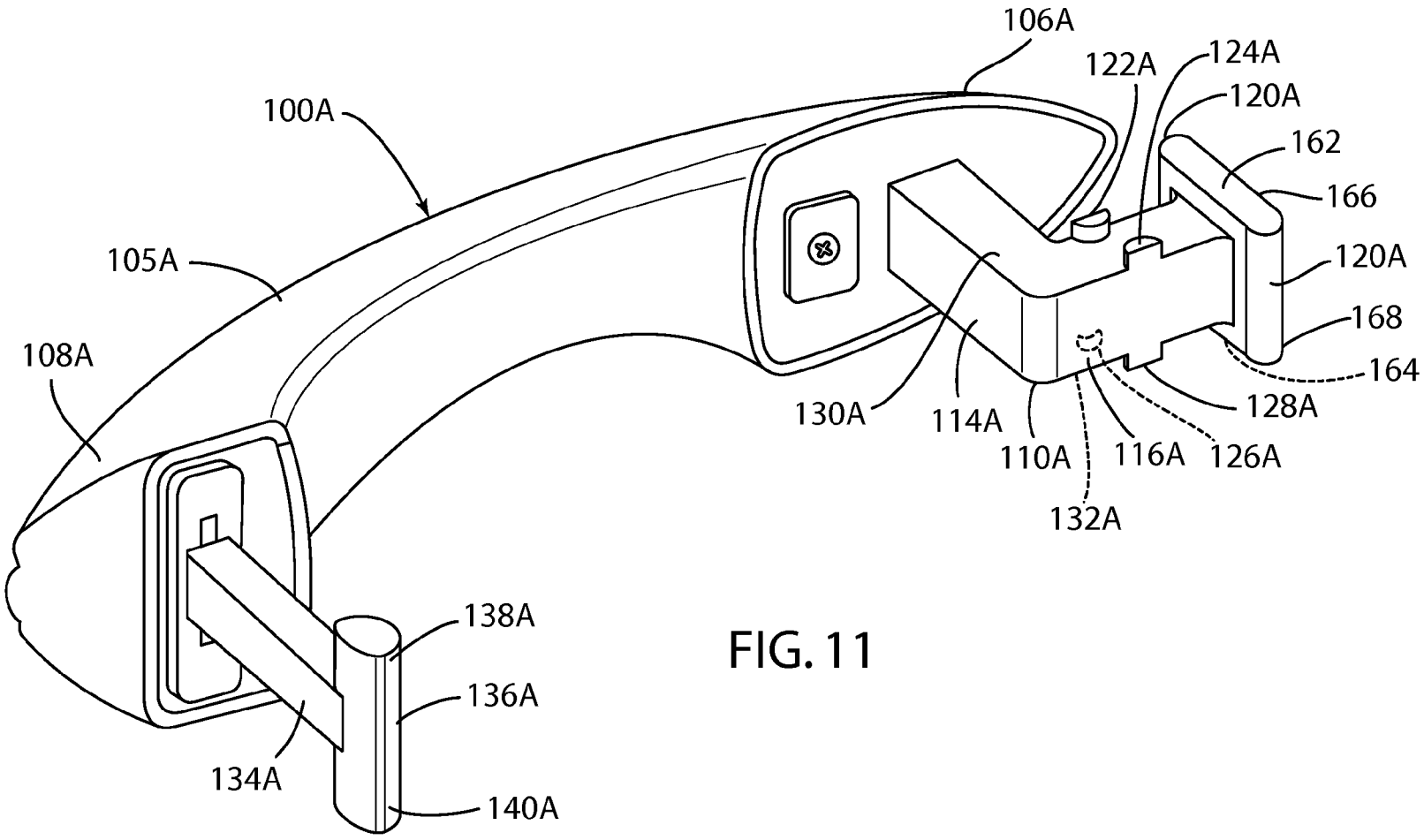
FIG. 11 is an isometric view of a vehicle door handle according to another aspect of the present invention.

A handle 100A (FIG. 11) according to another aspect of the present invention includes a handle strap 105A having forward and rearward ends 106A and 108A, respectively, and an extension 134A having an outer end 136A with upwardly and downwardly-extending pins 138A and 140A that are substantially identical to the corresponding components shown in the handle 100 of FIG. 7. Handle 100A also includes an extension 110A having first and second portions 114A and 116A, having upper and lower surfaces 130A and 132A, respectively. Pads 122A, 124A, 126A, and 128A are substantially identical to the corresponding components of handle 100 of FIG. 7. The handle 100A of FIG. 11 further includes upper and lower surfaces 162 and 164, respectively formed by upwardly and downwardly extending portions 166 and 168, respectively of extension 110A. The cylindrical surfaces 120A and pads 122A, 124A, 126A, and 128A slidably engage the surfaces of support structure 142 (FIG. 9). In the case of the handle assembly 100A, support structure 142 may include surfaces 150 and 152 that are recessed or notched as shown by the dashed lines designated 150A and 152A (FIG. 9). The extensions 166 and 168 (FIG. 11) and corresponding end surfaces 162 and 164, respectively, further ensure that the handle strap 105A does not experience looseness or wobble in operation.

Figure 12:
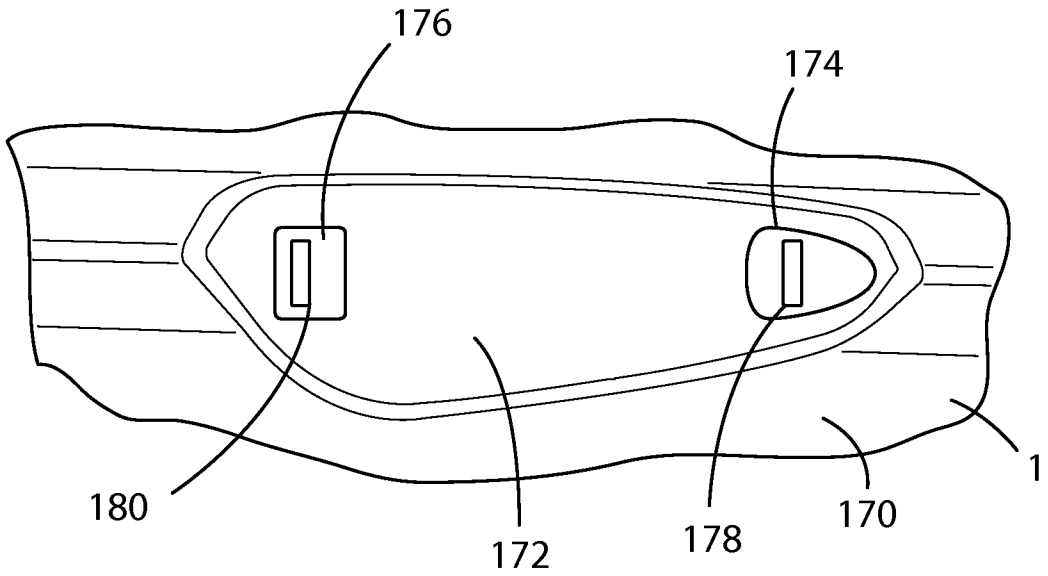
FIG. 12 is a partially fragmentary view of a portion of an outer panel of a door showing the landing areas for the handles.
Figure 13:
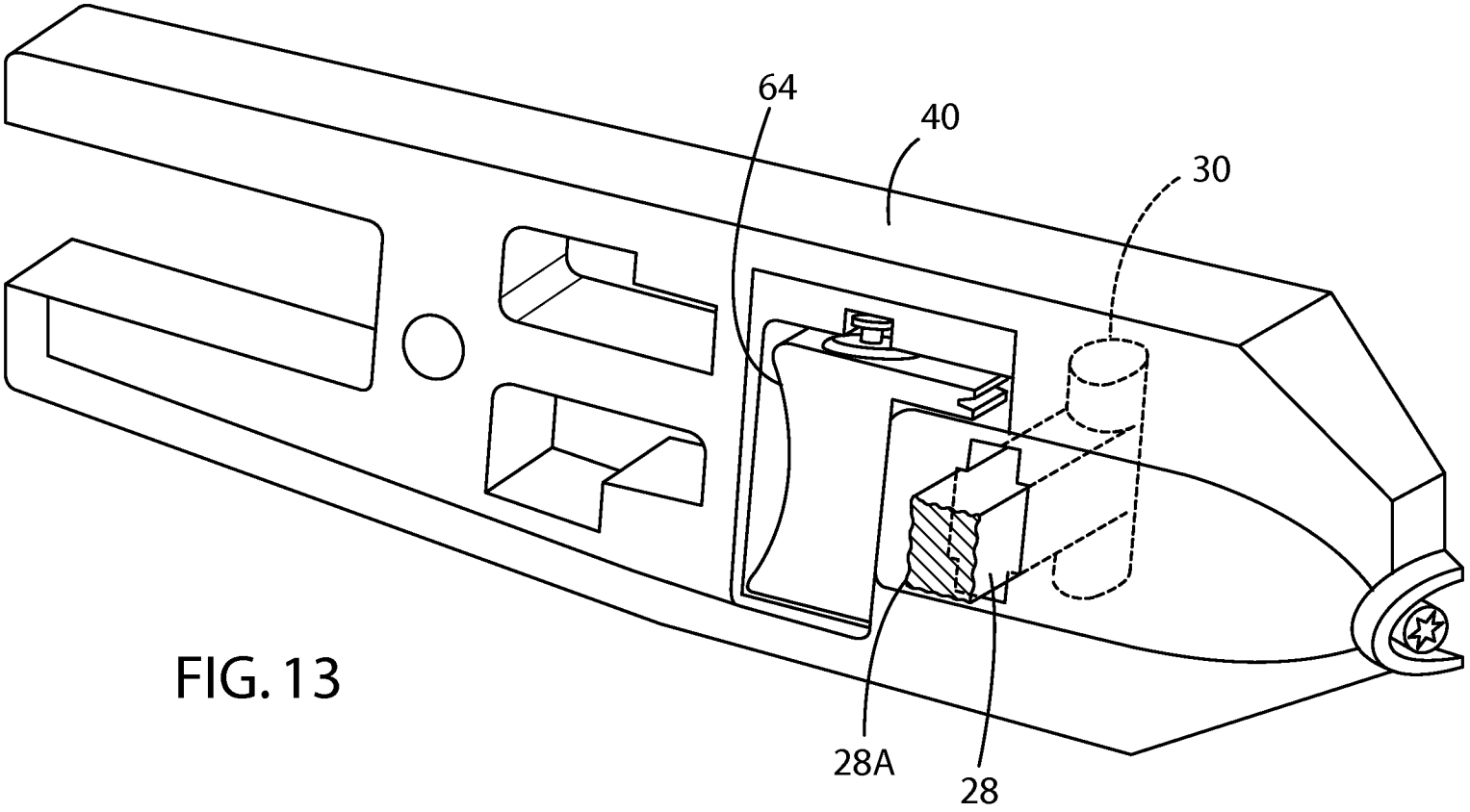
FIG. 13 is an isometric view of a handle according to the present invention.

With further reference to FIG. 12, the handle of the present invention may be installed to a door 1 of a motor vehicle having an outer skin or panel 170 formed from sheet metal or other suitable material. A pocket 172 may be formed in the outer panel 170, and a generally flat front landing area 174 and a flat rear landing area 176 may be formed in the pocket 172. The shape of the landing areas 174 and 176 generally correspond to the inner surfaces 12 and 13 of handle 5 (FIG. 1). Openings 178 and 180 are formed in the landing areas 174 and 176, respectively. During assembly, the extension 10 (FIG. 1) of handle 5 is inserted into opening 178, and pins 22 and 24 are inserted into slots 96 (FIG. 7) of front bellcrank 80. The tapered surface 94 of slots 96 facilitate insertion of pins 20 and 22 into slots 96. Handle 5 is then rotated, and rear extension 28 is inserted into opening 180 of rear landing area 176. Pins 32 and 34 of extension 28 are then inserted into slots 74 of rear bellcrank 56. The chassis 40 and reinforcement structure 50 (FIG. 2) may be secured to the door 1 in a manner that is substantially similar to known handle mounting arrangements. Chassis 40 and/or reinforcing structure 50 may include a pass through opening 28A having a "t" or swiss cross shape (FIG. 13) that receives rear extension 28 of handle 5 to thereby limit for-aft movement of handle 5 relative to door 1. The opening 28A constrains extension 28 from movement in the fore-aft direction.

It is to be understood that variations and modifications can be made on the aforementioned structure without departing from the concepts of the present invention, and further it is to be understood that such concepts are intended to be covered by the following claims unless these claims by their language expressly state otherwise.

What is claimed is:

1. An exterior door handle assembly for doors of motor vehicles, the handle assembly comprising:

first and second rotatable bellcranks, each having an upper finger having an upper slot with opposite surfaces, and a lower finger having a lower slot with opposite surfaces, wherein the upper and lower fingers are vertically spaced apart; and a handle having a central portion and first and second opposite end portions, the handle defining a longitudinal axis extending between the first and second opposite end portions, the first and second opposite end portions including first and second hook structures, respectively, each of the hook structures including an upwardly-extending pin received in the upper slot of a corresponding one of the first and second bellcranks and a downwardly extending pin received in the lower slot of a corresponding one of the first and second bellcranks, the pins having oblong cross-sectional shapes with opposite surfaces engaging the opposite surfaces of the upper and lower slots.

2. The handle assembly of claim 1, wherein:

each of the upwardly and downwardly extending pins have substantially identical cross-sectional shapes.

3. The handle assembly of claim 2, wherein:

the oblong cross-sectional shapes comprise waxing gibbous moon shapes.

4. The handle assembly of claim 3, wherein:

each of the upwardly and downwardly extending pins have first side portions having first outer surface portions that are substantially cylindrical, each of the upwardly and downwardly extending pins further including second side portions having second outer surface portions facing oppositely relative to the first outer surface portions, and wherein a second curvature that is significantly less than a first curvature of the first outer surface portions.

5. The handle assembly of claim 4, wherein:

the first hook structure comprises a front hook structure, and the second hook structure comprises a rear hook structure, and wherein the front hook structure is generally L-shaped in plan view.

6. The handle assembly of claim 5, wherein:

the rear hook structure is substantially T-shaped.

7. A door handle assembly for vehicle doors, the door handle assembly comprising: a support structure configured to be secured to a vehicle door; a pivot member rotatably connected to the support structure for rotation about a generally vertical axis, the pivot member comprising upper and lower pairs of spaced apart substantially planar bearing surfaces that face each other and include portions that are parallel to one another; and a handle member having a pin comprising an upwardly extending upper pin portion rotatably disposed between the upper pair of bearing surfaces and a downwardly extending lower pin portion rotatably disposed between the lower pair of bearing surfaces, wherein the upper pin portion has a non-circular cross-sectional shape that is substantially similar to that of a gibbous moon simultaneously contacting both bearing surfaces of the upper pair of bearing surfaces along lines of contact to rotatably connect the handle member to the pivot member for rotation about the pin; and wherein outward rotation of the handle member about the pin relative to the support structure causes the pivot member to rotate to release a door latch: the lower pin portion is vertically aligned with the upper pin portion, and wherein the lower pin portion has a cross-sectional shape that is substantially identical to the cross-sectional shape of the upper pin portion; and wherein: the lower pair of bearing surfaces are spaced below the upper pair of bearing surfaces; the upper pin portion slidably contacts the upper pair of bearing surfaces along the lines of contact, and the lower pin portion slidably contacts the lower pair of bearing surfaces along lines of contact.

8. The door handle assembly of claim 7, wherein:

the handle member comprises a handle strap having a forward end and a rearward end, the handle member having a front connecting structure extending from the forward end of the handle strap, and wherein the upper and lower pin portions extend from the front connecting structure.

9. The door handle assembly of claim 8, wherein:

the handle member includes a rear connecting structure extending from the rear end of the handle strap, the rear connecting structure including upper and lower pins; and wherein:

the pivot member comprises a first pivot member; and wherein the door assembly further comprises:

a second pivot member rotatably connected to the support structure, the second pivot member including upper and lower pairs of bearing surfaces, the upper pin portion of the rear connecting structure slidably contacting the upper pair of bearing surfaces along lines of contact, the lower pin portion of the rear connecting structure slidably contacting the lower pair of bearing surfaces along lines of contact; and wherein:

the upper and lower pin portions of the rear connecting structure cause the second pivot member to rotate as the handle member is rotated outwardly.

10. The door handle assembly of claim 9, wherein:

the upper and lower pin portions of the front connecting structure have a non-circular cross-sectional shape that is substantially the same as that of a waxing gibbous moon.

11. A vehicle door, comprising:

front and rear bellcranks, each having upper and lower U-shaped slots; and a handle having T-shaped front and rear hooks engaging the front and rear bellcranks, respectively, each hook having upwardly and downwardly extending pins defining oblong cross sectional shapes, each upper and lower pin having opposite surfaces simultaneously slidably engaging a respective one of the upper and lower slots along two vertical lines of contact so as to rotate the bellcranks when the handle is actuated and wherein the front and rear bellcranks each include an upper finger having the U-shaped slot and a lower finger having the U-shaped slot, wherein the upper and lower fingers are vertically spaced apart.

12. The vehicle door of claim 11, including:

a latch mechanism configured to selectively retain the door in a closed position, and wherein at least one of the bellcranks is operably connected to the latch such that rotation of the at least one of the bellcranks unlatches the latch mechanism.

* * * * *